US008651396B2

(12) United States Patent
Spearman, Sr.

(10) Patent No.: US 8,651,396 B2
(45) Date of Patent: Feb. 18, 2014

(54) PERSONAL DEFENSE DEVICE

(76) Inventor: Donald M Spearman, Sr., Greenville, SC (US)

( * ) Notice: Subject to any disclaimer, the term of this patent is extended or adjusted under 35 U.S.C. 154(b) by 208 days.

(21) Appl. No.: 13/272,754

(22) Filed: Oct. 13, 2011

(65) Prior Publication Data

US 2013/0092763 A1 Apr. 18, 2013

(51) Int. Cl.
*B05B 9/08* (2006.01)

(52) U.S. Cl.
USPC ..... 239/152; 239/154; 239/289; 239/346; 239/602; 239/DIG. 19; 222/78; 222/82; 222/175; 222/215; 224/148.2; 224/196; 224/664

(58) Field of Classification Search
USPC ..... 239/152–154, 289, 302, 346, 602, 239/DIG. 19; 222/3, 78, 82, 107, 175, 192, 222/215; 224/196, 575, 576, 664, 148.2
See application file for complete search history.

(56) References Cited

U.S. PATENT DOCUMENTS

| | | | | |
|---|---|---|---|---|
| 4,223,804 | A | 9/1980 | Morris et al. | |
| 4,308,976 | A * | 1/1982 | Speer et al. | 222/78 |
| 4,846,044 | A | 7/1989 | Lahr | |
| 5,088,624 | A | 2/1992 | Hackett et al. | |
| 5,331,523 | A | 7/1994 | Delzer | |
| 5,374,919 | A * | 12/1994 | Zelka et al. | 224/664 |
| 5,775,543 | A * | 7/1998 | Wahrenbrock | 222/175 |
| 6,281,800 | B1 | 8/2001 | Sizemore | |

OTHER PUBLICATIONS

Center for Wildlife Information; Be Bear Aware Bear Spray; Web site print outs from www.centerforwildlifeinformation.org/BeBearAware/BearSpray/bearspray.html; visited Oct. 13 2011; publisher is Center for Wildlife Information, no volume number, Missoula, Montana, USA; copyright by Center for Wildlife Information ; (3 pages).

* cited by examiner

*Primary Examiner* — Steven J Ganey
(74) *Attorney, Agent, or Firm* — Metz Lewis Brodman Must O'Keefe; Neal P Pierotti

(57) ABSTRACT

A personal defense device is provided that includes an irritant. The personal defense device may have an irritant dispensing member that is carried on the back of a user. The irritant dispensing member may be configured for dispensing the irritant such that the irritant is dispensed behind the user.

18 Claims, 7 Drawing Sheets

PERSONAL DEFENSE DEVICE

FIELD OF THE INVENTION

The present invention relates generally to a personal defense device for protecting an individual from attacks from other people and wildlife. More particularly, the present application involves a personal defense device that dispenses an irritant from the back of the user and/or by way of a balloon to prevent a person, bear, or other animal from injuring the person and allowing him or her to escape.

BACKGROUND

The use of irritants such as pepper spray, bear spray, and other substances that are generally non-lethal in nature are known for use in self-defense. For example, bear spray may be provided in a pressurized canister that is actuated through a valve and trigger mechanism. Bear attacks happen when a bear feels threatened by the presence of the hiker in the bear's area, or when the bear views the hiker as a potential food source. Although playing dead by the hiker may work in some instances to diffuse the bear encounter, in the case of black bears or hungry bears, a hiker may be thrown down onto the ground, mauled, and eventually killed as playing dead will not work in these circumstances.

Hikers often carry bear spray to defend themselves from these sorts of attacks. However, the hiker must be able to access the bear spray before being attacked, or when hiker is on the ground being mauled. The hiker must take aim at the charging bear and dispense the bear spray in a cloud that hits the bear in the face. The hiker may be so nervous or excited that he or she cannot access the bear spray fast enough or aim it accurately enough to hit the bear in the face or create a cloud sufficient to repel the attack. Some bears, most likely those previously sprayed in the face with bear spray, have been known to turn their head during an attack to avoid the bear spray. Also, while on the ground being mauled, the hiker will have to fumble through his or her backpack to find the bear spray, or may have to access the bear spray that is carried in a holster on the hip of the hiker. This additional movement may cause the bear to attack again because the bear thinks the hiker is being aggressive, or the hiker may not be able to access the bear spray due to being mauled, nervous, excited, or from not thinking clearly. Further, should the initial blast of bear spray towards the charging bear prove ineffective, the hiker may have used up all of the bear spray and will have no other option for defense should the hiker be thrown face down onto the ground and mauled by the bear. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
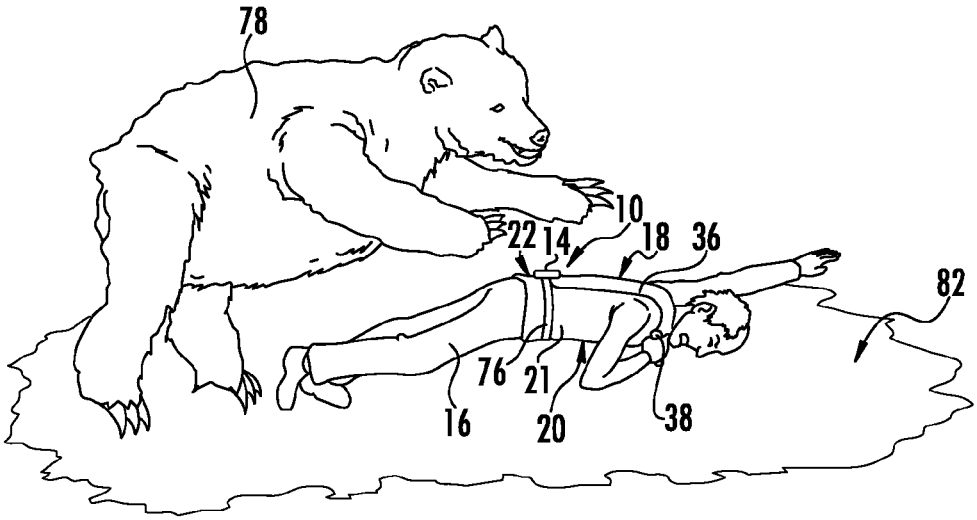
FIG. 1 is a perspective view of a user wearing a personal defense device and laying face down on the ground while being attacked by a bear.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a personal defense device 10 that may be used by a user 16 to protect himself or herself during a bear attack, mugging, or other situation in which personal defense is needed. The personal defense device 10 may provide non-lethal force in the form of an irritant 12 that is applied to the attacker 78 to inflict pain, blindness, disorientation, and/or other non-lethal symptoms. The personal defense device 10 may include an irritant dispensing member 14 that is carried by the back 18 of the user 16 so that dispensing of the irritant 12 occurs behind the user 16 so that the face of the user 16 will not be effected by the irritant 12 and thus the user will not be inadvertently effected by the irritant 12 during an attack. The irritant dispensing member 14 may be or include a balloon 80 in certain embodiments that is inflated by an actuation device 26. The balloon 80 is inflated to such an extent by the actuation device 26 that it will burst thus causing the irritant 12 inside of the balloon 80 to be projected outwards towards or onto the attacker 78. The balloon 80 may be a heavyweight balloon and can be made out of any material capable of being expanded and exploding under pressure. In accordance with one exemplary embodiment, the balloon 80 is a TRAXXAS® 3175 rubber balloon provided by Traxxas, having offices located at 1100 Klein Road, Plano, Tex., 75074, USA.

One exemplary embodiment of the personal defense device 10 is illustrated with reference to FIG. 1. Here, a user 16 is laying face down and is injured, pretending to be dead, or otherwise attempting to escape the attack of a bear 78. Although pretending to be dead may allow a user 16 to escape some bear attacks, certain bears like black bears are not persuaded from ceasing an attack on a presumably dead individual. Further, bears 78 may maul or otherwise severely injure a person 16 that pretends to be dead. The personal defense device 10 may afford the user 16 a last means of defense in instances when evading the bear 78 through other means has failed. For example, the user 16 may have sprayed a cloud of irritant 12 at the bear 78 but failed to hit the bear 78 or otherwise discouraged the bear 78 from attack. In this case, the user 16 may be forced onto the ground in a helpless position and unable to fight back. The personal defense device 10 may provide protection for the user 16 when he or she finds himself or herself in the vulnerable position.

The personal defense device 10 may be worn around the waist 21 of the user 16. An irritant dispensing member 14 of the personal defense device 10 may be located on the small of the back 22 of the user 16. In this position, actuation of the personal defense device 10 will cause irritant 12 to be dispensed from the back 18 of the user 16. The irritant 12 will not be directed towards the front 20 of the user 16 so that the irritant 12 will not adversely effect the eyes, hands, mouth, nose, face, or arms of the user 16 which will generally be located at the front 20 of the user 16 during an attack. This may even be more so the case in the position of user 16 during the attack shown in FIG. 1 in which the user is laying down so that his or her front 20 is on top of the ground 82. Dispensing of the irritant 12 behind the user 16 keeps the user 16 safe from the irritant 12 and effects the attacker 78 who is in fact behind the user 16.

The personal defense device 10 may include a trigger member 36 with a handle 38 that is easily accessed by the user 16 when laying face down on the ground 82. The user 16 may secretively actuate the trigger member 36 without the attacker 78 noticing thus completely surprising the attacker 78 or preventing the attacker 78 from noticing and thus stopping the user 16 from pulling the trigger member 36. Although described in connection with a bear 78, it is to be understood that this is only for sake of convenience and that the personal defense device 10 can be used to defend the user 16 from people, or other forms of wildlife or animals besides bears.

Figure 2:
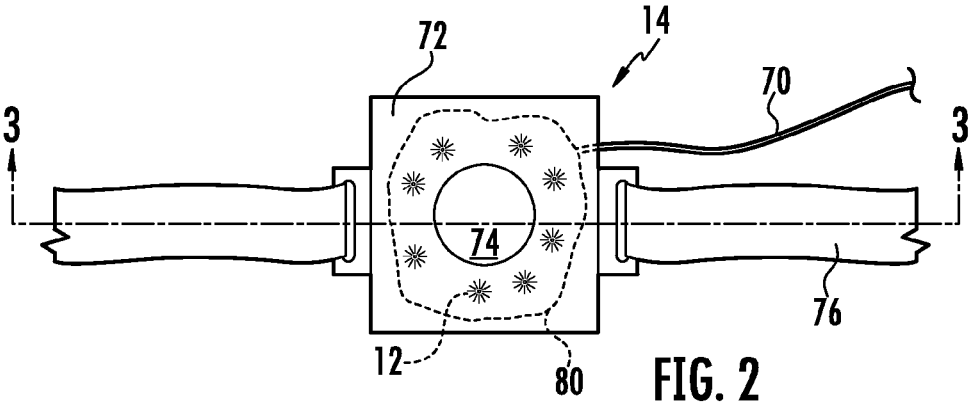
FIG. 2 is a front view of an irritant dispensing member in accordance with one exemplary embodiment in an unactuated state.
Figure 3:
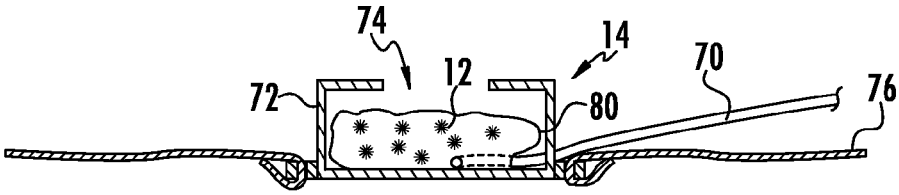
FIG. 3 is a cross-sectional view taken along line 3-3 of FIG. 2.

The personal defense device 10 includes an irritant dispensing member 14, one exemplary embodiment of which is shown in FIGS. 2 and 3 in an unactuated state. The irritant dispensing member 14 may include a balloon 80 in one embodiment that has therein an irritant 12. The irritant 12 may be pepper spray, bear spray, or any other type of irritant capable of incapacitating or otherwise defending off an attacker 78 of the user 16. The irritant 12 may be a non-lethal substance. The active ingredient in the irritant 12 may be oleoresin capsicum (OC) and may be made from strong, hot cayenne and other peppers. The amount of oleoresin capsicum in the irritant 12 may be 10% in some embodiments, and may be from 5% to 18% in others. However, the irritant 12 when configured as pepper spray may be made of any number of ingredients and any amount of ingredients effective for defending against a person or animal attacking the user 16. The active ingredient in the irritant 12, normally when configured as bear spray, may be capsaicin and related capsaicinoids. The concentration of capsaicin and related capsaicinoids may range from 1%-2% in certain versions of the irritant 12 when arranged as a bear spray. However, the irritant 12 when configured as bear spray may be made of any number of ingredients and any amount of ingredients effective for defending against a bear attack. Although described as being variously configured, the irritant 12 may be effective on the attacker 78 when it contacts the attacker's 78 mouth, nose, or eyes. The irritant 12 may cause coughing, choking, blindness, nausea, and may hinder the breathing and cause disorientation to the attacker 78. It is to be understood that as used herein that the term "irritant" is broad enough to encompass bear spray, pepper spray, or any other substance that functions to hinder an attacker 78 when attacking the user 16.

The irritant dispensing member 14 may include a housing 72 that functions to house the balloon 80 in the unactuated state. The housing 72 may be made of plastic or metal, can be flexible or rigid in construction, and can be variously configured. In some embodiments, the housing 72 may be made of nylon. The housing 72 may have an interior into which the balloon 80 is located and protected from the elements or damage. The irritant dispensing member 14 may be worn by the user 16, and a belt 76 may be attached to the irritant dispensing member 14 for this purpose. The belt 76 can be positioned around the waist 21 of the user 16 so that the housing 72 and balloon 80 are located at the small of the back 22. The belt 76 may be made of leather, nylon, cloth, or any other material and can be affixed to the housing 72 in a variety of manners. The housing 72 may have loops on either end through which a portion of the belt 76 is disposed in order to cause the belt 76 to be attached to the housing 72. Although described as using a belt 76 to attach the housing 72 to the user 16, a belt 76 need not be used in other embodiments and other mechanisms of causing the housing 72 to be carried by the user 16 may be employed.

The balloon 80 may be located within the entire interior of the housing 72, or may fill up only part of the interior of the housing 72 when deflated. An aperture 74, that may be circular in shape, may be defined through a wall of the housing 72. The aperture 74 may be completely open so that the balloon 80 is exposed to air, contact, and the environment. In such instances, the remaining portion of the housing 72 will still function to protect the balloon 80. In other embodiments, a thin film or other cover capable of being opened may be placed to close the aperture 74 to prevent access to air, contact, and the environment when the balloon 80 is located inside of the housing 72 during storage. The irritant 12 may be located inside of the balloon 80 when the balloon 80 is deflated and located completely within the housing 72. An inflation line 70 is placed into fluid communication with the balloon 80 and inflation gas 30 is capable of flowing through the inflation line 70 and into the balloon 80 to inflate same. The inflation line 70 may extend through an opening in the housing 72 and can be located some amount into the interior of the housing 72 until it engages and is ported with the balloon 80. In other arrangements, the inflation line 70 will be located completely outside of the housing 72 and the balloon 80 will be placed into fluid communication with the inflation line 70 via a port through a wall of the housing 72.

The balloon 80 and irritant 12 are thus carried by the irritant dispensing member 14 when they are in an unactuated state. Once irritant 12 is desired to be dispensed, inflation gas 30 is introduced into the balloon 80 to cause the balloon 80 to be inflated. Inflation of the balloon 80 is shown with reference to FIG. 4 in which the inflation gas 30 has entered the balloon 80 to cause the balloon 80 to inflate. The balloon 80 may be secured to an interior wall of the housing 72 so that it is prevented from flying out of the housing 72 during inflation. Additionally or alternatively, the balloon 80 may be appropriately secured to the inflation line 70 so that the balloon 80 remains attached to the inflation line 70 during inflation. The balloon 80 will expand and may fill the entire interior of the housing 72. Continued expansion may force the balloon 80 through the aperture 74 and outside of the housing 72. The balloon 80 will continue to expand outside of the housing 72 until it reaches its break point.

Figure 5:
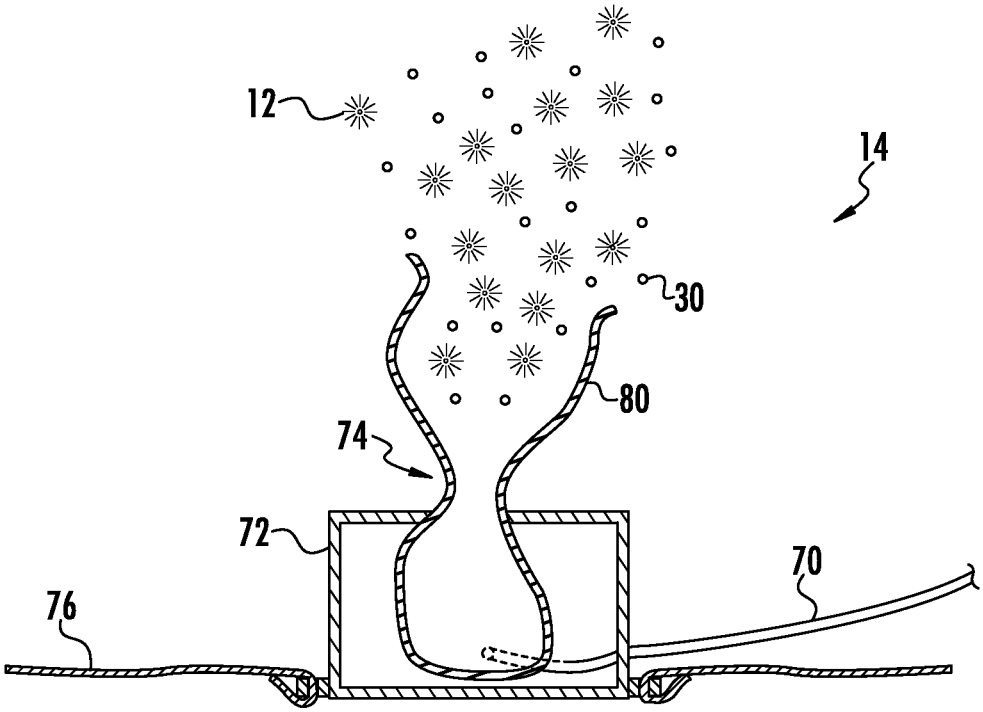
FIG. 5 is a cross-sectional view of the irritant dispensing member of FIG. 2 in an actuated state in which the balloon has burst to cause irritant to be dispensed.

With reference now to FIG. 5, the balloon 80 is shown bursting due to continued pressure exerted by the inflation gas 30. The inflation gas 30 will be placed into the balloon 80 to such a degree that the balloon 80 will expand to full expansion size (although constrained by the housing 72) and then break at such time the wall making up the balloon 80 can no longer handle the internal pressure. The breaking of the wall of the balloon 80 is illustrated and when this happens, the irritant 12 located within the balloon 80 will be dispensed. The breaking of the balloon 80 may be a violent explosion or of such force sufficient to cause the irritant 12 to be expelled from the balloon 80. A cloud, stream, or ray of irritant 12 may be expelled upon bursting of the balloon 80. The irritant 12, inflation gas 30, and other gas located within the balloon 80 may be expelled in the direction away from the user 16.

Figure 4:
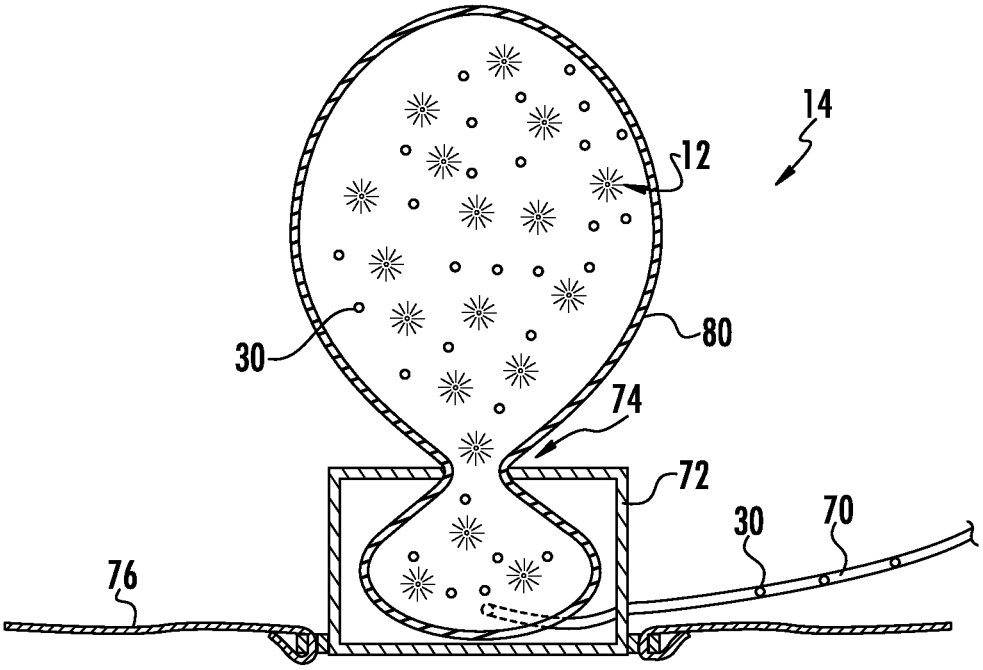
FIG. 4 is a cross-sectional view of the irritant dispensing member of FIG. 2 in an actuated state in which a balloon has not yet burst.

The pinching caused by the constriction of aperture 74 may cause the balloon 80 to rupture at the aperture 74 in some arrangements. In other arrangements, the balloon 80 may be designed so as to have a wall weakness located at its apex at maximum inflation, as shown in FIG. 4, so that it breaks at this top point. Breakage at the apex is illustrated with reference to FIG. 5. However, it is to be understood that the balloon 80 may rupture at any location in other embodiments. The inflation gas 30 may be transferred into the balloon 80 and may be of such a pressure that the balloon 80 will expand and break in an extremely short amount of time. For example, expansion and breakage may occur in less than one second upon the time when the inflation gas 30 first enters the balloon 80. Aside from showering the attacker 78 with irritant 12, the breakage of the balloon 80 may create a very loud sound that may further act to scare the attacker 78. The sound from the balloon 80 may distract the attacker 78, disorient the attacker 78, or provide some other confusion that may allow the user 16 additional time to escape or cause the attacker 78 to break off the attack.

Figure 6:
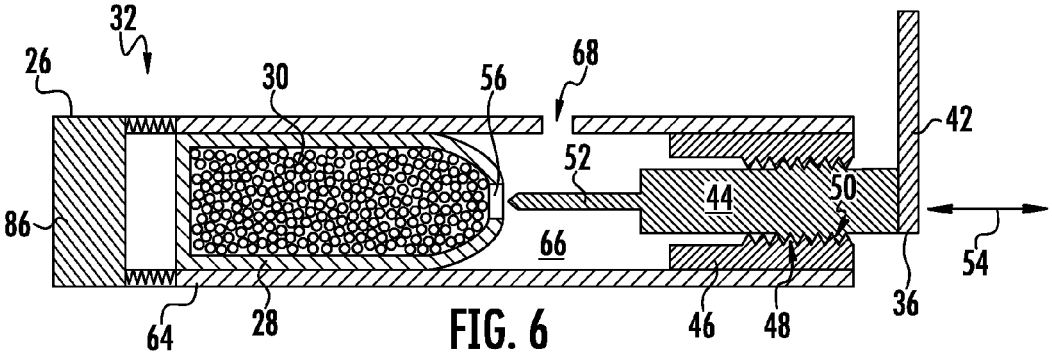
FIG. 6 is a cross-sectional view of an actuation device in an unactuated state in accordance with one exemplary embodiment.

The inflation gas 30 may be stored in an actuation device 26 that can be actuated by the user 16 when desired to cause the inflation gas 30 to be transferred to the irritant dispensing member 14 to cause the balloon 80 to be inflated. The actuation device 26 may be located on or at the housing 72 or may be located separate from the housing 72 and placed into fluid communication with the irritant dispensing member 14 via the inflation line 70. One exemplary embodiment of the actuation device 26 is shown with reference to FIG. 6. The actuation device 26 is in the unactuated state 32 in which the inflation gas 30 is prevented by the actuation device 26 from being transferred to the irritant dispensing member 14. The actuation device 26 includes a body 64 that can be made out of a variety of materials such as brass, plastic, steel, or aluminum. The body 64 may be leak proof such that the only areas from which the inflation gas 30 can escape are those areas specifically desired for the inflation gas 30 to escape. A removable cap 86 can be included on one end of the body 64. The removable cap 86 may include threads that allow it to be threaded onto and off of the body 64 to be attachable and removable from the body 64. The removable cap 86 may be removed in order to access a pressurized cartridge 28 or other member of the actuation device 26 in order to repair or replace components of the actuation device 26. In other arrangements, the end of the body 64 can be permanently closed or sealed so that the interior of the body 64 cannot be accessed.

The actuation device 26 can include a pressurized cartridge 28 that includes the inflation gas 30. The inflation gas 30 may be any type of gas or fluid such as air, oxygen, carbon dioxide, or water. The pressurized cartridge 28 includes the inflation gas 30 under pressure so that when released, the inflation gas 30 can flow to the balloon 80 or other member and cause dispensing of the irritant 12 without need to resort to pumps or other mechanisms to cause a pressure increase. The pressurized cartridge 28 may be a $CO_2$ cartridge in accordance with one exemplary embodiment. The pressurized cartridge 28 may be snugly fit within the body 64 so that it will not move in a linear direction 54 of the body 64 when worn and moved by the user 16. Alternatively, the pressurized cartridge 28 may be attached to the inner surface of the body 64 by any adequate means so that it is constrained from movement in the linear direction 54. Further, the pressurized cartridge 28 may be rigidly attached to the removable cap 86 so that the location of the pressurized cartridge 28 within the body 64 is known and fixed during use.

A trigger member 36 may be provided and can be actuated by the user in order to actuate the actuation device 26. In this regard, the trigger member 36 may be used to move a threaded plunger 44 of the actuation device 26. The threaded plunger 44 may have threads 48 that are external threads that engage complimentary internal threading 50 of a wall 46 of the actuation device 26. Threads 48 and 50 may extend the same length or different lengths in the linear direction 54. Although the wall 46 is shown as being thicker in the area forming the threads 50, the wall 46 may be of the same thickness along the entire length of the body 26 in the linear direction 54 and it is to be understood that variations of the shape and size of the wall 46 are possible. The threaded plunger 44 may be attached to the trigger member 36 so that rotational movement of the trigger member 36 causes a corresponding rotational movement of the threaded plunger 44. Since the threaded plunger 44 is engaged to the wall 46 via threads 48 and 50, rotational movement of the threaded plunger 44 will be translated into linear movement of the threaded plunger 44 in the linear direction 54. The threads 48 and 50 may be provided in a variety of manners so that any amount of rotation of the threaded plunger 44 causes any amount of movement in the linear direction 54. For example, a one half rotation of the threaded plunger 44 may cause the threaded plunger 44 to move one inch in the linear direction 54.

The threaded plunger 44 may have a piercing member 52 disposed on one end that is opposite to the end that engages the trigger member 36 in the linear direction 54. The piercing member 52 may terminate in a sharp point on its terminal end. The body 64 defines an interior passageway 66 through which fluid may flow. The body also defines an outlet port 68 through the side of wall 46. Although not shown, the inflation line 70 may be engaged to the outlet port 68. The piercing member 52 is positioned away from a breakable seal 56 of the pressurized cartridge 28 so that the breakable seal 56 remains unbroken and the inflation gas 30 remains within the pressurized cartridge 28 when the actuation device 26 is in the unactuated state 32. The components of the actuation device 26 are and remain stationary up until the time the trigger member 36 is actuated so that the actuation device 26 does not inadvertently actuate.

Figure 7:
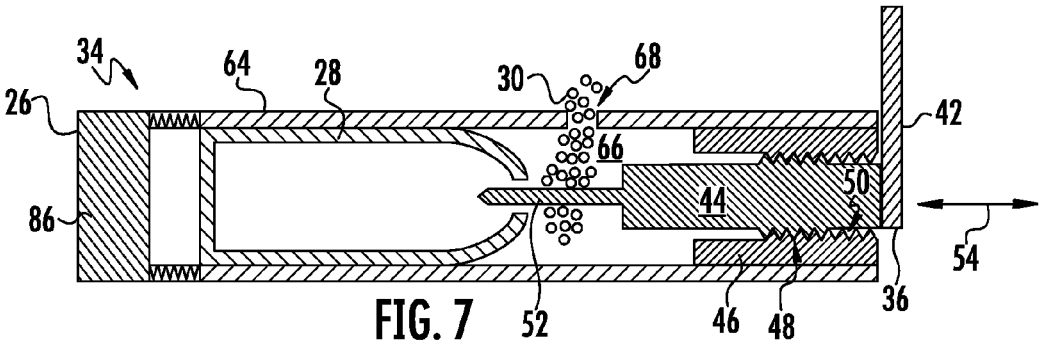
FIG. 7 is a cross-sectional view of the actuation device of FIG. 6 in an actuated state.

When the user 16 desires the irritant 12 to be dispensed, he or she actuates the trigger member 36 to cause the trigger member to rotate. The trigger member 36 may include a wheel or arm 42 that is capable of being rotated. This wheel or arm 42 is rigidly engaged to the threaded plunger 44 so that the threaded plunger 44 will rotate and likewise move in the linear direction 54. As discussed, movement in the linear direction 54 will be towards the pressurized cartridge 28 so that the attached piercing member 52 moves in the linear direction 54 towards the breakable seal 56 of the pressurized cartridge 28. The piercing member 52 will engage and break the breakable seal 56 as shown with reference to FIG. 7 that shows the actuation device 26 in an actuated state 34. Because the contents of the pressurized cartridge 28 are under pressure, breakage of the breakable seal 56 causes this pressure to be released so that the inflation gas 30 within the pressurized cartridge 28 flows out of the pressurized cartridge 28, past the inserted portion of the piercing member 52 and into the interior passageway 66 of the body 64. The body 64 is made so as to be fluid tight thus causing the inflation gas 30 to have to exit the interior passageway 66 at the outlet port 68 as desired. The inflation gas 30 will exit through the outlet port 68 and be directed to the balloon 80 or other component of the irritant dispensing member 14 for inflation and dispensing of the irritant 12.

Once actuated, the user 16 may remove the spent pressurized cartridge 28 via the removable cap 86 and replace same with a new, charged pressurized cartridge 28. The user can also rotate the threaded plunger 44 back to its position in the unactuated state 32 so that the actuation device 26 can be reused. In other arrangements, the actuation device 26 is designed for single use and is disposable once actuated.

Figure 8:
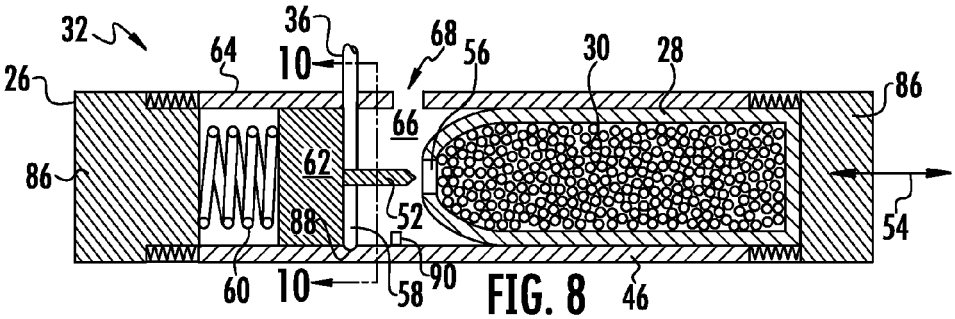
FIG. 8 is a cross-sectional view of an actuation device in an unactuated state in accordance with another exemplary embodiment.

Additional embodiments of the actuation device 26 are possible. FIG. 8 shows the actuation device 26 in an unactuated state 32. Both ends of the body 64 in the linear direction 54 are fitted with removable caps 86. The pressurized cartridge 28 is located within the body 64 and contains the inflation gas 30. The pressurized cartridge 28 may be attached to the removable cap 86, to the wall 46, or otherwise secured within the body 64 so that it does not move in the linear direction 54. The actuation device 26 also includes a plunger 64 and a spring 60. Spring 60 engages on one end the removable cap 86 opposite the removable cap 86 previously mentioned. The removable caps 86 can be used to access the actuation device 26 for recharging. Although engaging the removable cap 86, the spring 60 could engage the wall 46 of the actuation device 26 in other embodiments. The spring 60 is under compression in the unactuated state 32 so that it functions to urge the plunger 62 towards the pressurized cartridge 28. The plunger 62 is not threaded in the exemplary embodiment shown, but could include slots or tracks that function to guide its movement in the linear direction 54 along the body 64. The piercing member 52 is rigidly attached to the plunger 62.

Figure 10:
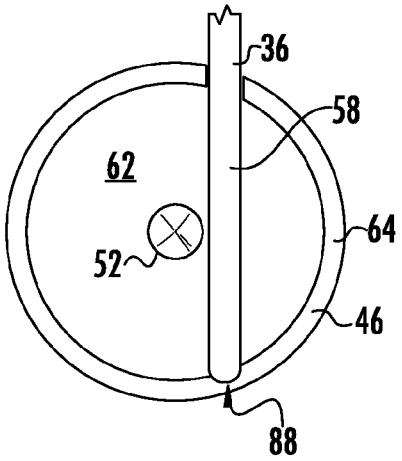
FIG. 10 is a cross-sectional view taken along line 10-10 of FIG. 8.

Movement of the plunger 62 and piercing member 52 in the linear direction 54 towards the pressurized cartridge 28 is limited by a pin 58 of the trigger member 36. The plunger 62 engages the pin 58 and the pin 58 acts as a stop to prevent the plunger 62 from further extending in the linear direction 54. The pin 58 extends through an opening in the wall 46 of the body 64 and into the interior of the body 64. The pin 58 extends through the interior of the body 64 and into a depression 88 in the wall 46 of the body 64 located opposite to the entry point of the pin 58 into the body 64. The depression 88 functions as a guide as to where to place the pin 58 and provides a step for holding the pin 58 in place. FIG. 10 is a view taken along line 10-10 of FIG. 8 in which the arrangement of the pin 58 can be more easily seen. The pin 58 is offset from the piercing member 52, but may engage the piercing member 52 in some arrangements.

Figure 9:
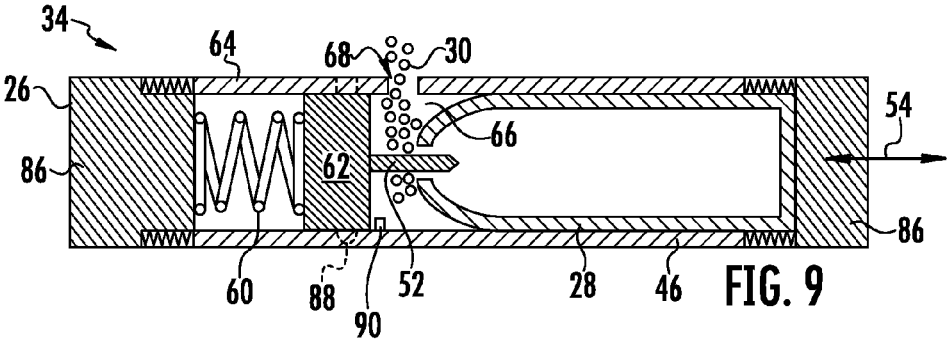
FIG. 9 is a cross-sectional view of the actuation device of FIG. 8 in an actuated state.

FIG. 9 shows the actuation device 26 of FIG. 8 in the actuated state 34. When actuation is desired, the user 16 will remove the pin 58 from the depression 88 and out of the interior of the body 64. This removal may be effected through simply pulling the pin 58 with his or her hand, or may be made by pulling a separate component of the trigger member 36 that functions to in turn pull the pin 58. For example, a handle 38 and pull cord 40 arrangement may be incorporated into the trigger member 36 so that pulling the handle 38 causes the pull cord 40 to move to cause the pin 58 to be removed from the interior of the body 64. Once the pin 58 is removed from engagement with the plunger 62, the spring 60 may function to further urge the plunger 62, and hence the piercing member 52, towards the breakable seal 56 of the pressurized cartridge 28. The plunger 62 will move towards the breakable seal 56 in the linear direction 54 until the piercing member 52 engages and punctures the breakable seal 56 causing the pressurized inflation gas 30 to be expelled from the pressurized cartridge 28. The inflation gas 30 will flow into the interior passageway 66 and out of the outlet port 68 of the body 64. Again, an inflation line 70 may be in communication with the outlet port 68 to appropriately channel the inflation gas 30.

A stop 90 may extend inward from the wall 46 into the interior passageway 66. The spring 60 may urge the plunger 62 in the linear direction 54 until the plunger 62 engages the stop 90 at which point its movement in the linear direction 54 is ceased. The plunger 62 may move forward to such an extent that it functions to block the aperture through which the pin 58 was inserted so as to be disposed within the body 64. This blockage may prevent the inflation gas 30 from exiting through the opening present for the pin 58 and instead forcing the inflation gas 30 to flow through the outlet port 68. In other arrangements, a stop 90 is not present. Here, the plunger 62 may move all the way up to or even against the pressurized cartridge 28. The plunger 62 could itself include one or more outlet ports through which the pressurized inflation gas 30 may flow. Additionally or alternatively, the piercing member 52 may have a bore or other opening through which the inflation gas 30 may flow once the breakable seal 56 is broken. This bore or other opening may be in fluid communication with the outlet port 68 so that the inflation gas 30 can properly flow out through the actuation device 26. The actuation device 26 can be variously arranged so that it is capable of dispensing the inflation gas 30 out of the outlet port 68 when desired in accordance with other exemplary embodiments.

Although described as using a breakable seal 56 and piercing member 52, the device 10 can be arranged in other embodiments so that the pressurized cartridge 28 can emit pressurized inflation gas 30 without the need for these components or via other channels. For example, a Trinity $CO_2$ on-off pin valve can be used to regulate the dispensing of inflation gas 30 from the pressurized cartridge 28 and may be provided by punisherspb.com having offices located at 309 Freeport Road, Aspinwall, Pa., 15215, USA. Further, any type of pressurized cartridge 28 may be used, and the device 10 is not limited to a particular type or even to the use of a pressurized cartridge 28. In accordance with one exemplary embodiment, the pressurized cartridge 28 may be a $CO_2$ cartridge as provided by Gas Depot having offices located at 6727 Northwest $16^{th}$ Terrace, Ft. Lauderdale, Fla., 33309, USA.

Figure 11:
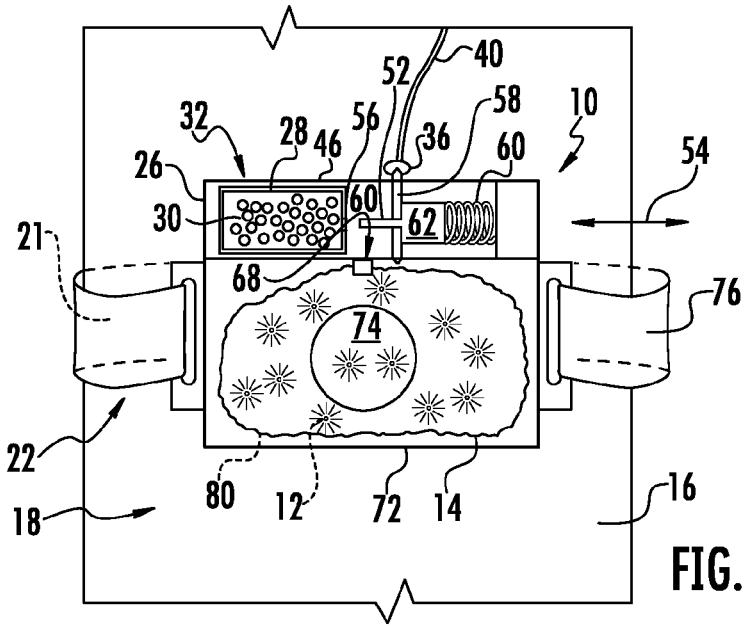
FIG. 11 is a partial cross-sectional front view of a personal defense device worn on the back of a user in accordance with another exemplary embodiment.

FIG. 11 shows another exemplary embodiment of the personal defense device 10 attached to the waist 21 of the user 16. The personal defense device 10 includes a belt 76 that the user 16 attaches to his or her waist so that the irritant dispensing member 14 is located at the small of the back 22 of the user 16. The belt 76 can include any fastener that allows it to be attached to itself to effect attachment to the user 16. When described as being located or carried by the user 16, it is to be understood that clothing or other items may or may not be located between the components of the personal defense device 10 and the skin of the user 16. As such, it is to be understood that pants, belts, shirts, jackets, bags, backpacks, or other articles of clothing or other items can be present between the components of the personal defense device 10 and the skin of the user 16 and the components of the personal defense device 10 are still understood to be carried by the user 16. The actuation device 26 includes a spring 60 that forces the plunger 62 and piercing member 52 in the linear direction 54 once the pin 58 is removed from its blocking position. The pin 58 may be connected to a pull cord 40 that applies force to the pin 58 to cause the pin 58 to be removed from its blocking position. Once removed, the piercing member 52 can pierce the breakable seal 56 and pressurized inflation gas 30 may enter the interior passageway 66.

The embodiment in FIG. 11 features a personal defense device 10 in which the irritant dispensing member 14 is located proximate to the actuation device 26. These two components may be in engagement with one another, and may in some instances be housed or carried by the same frame. This frame may be a combination of the body 64 and the housing 72. As such, both the irritant dispensing member 14 and the actuation device 26 may be located at the small of the back 22 of the user 16. The irritant dispensing member 14 has a balloon 80 that is attached to outlet port 68. A separate inflation line 70 is not present. The outlet port 68 may be a nipple onto which the balloon 80 is affixed. Alternatively, the outlet port 68 may simply be an open space and the balloon 80 can be attached to a wall of the housing 72 so that an opening of the balloon 80 is in fluid communication with the outlet port 68. Still further, the balloon 80 may have a nipple or other member that is inserted through the port 68 into the internal passageway 66 to cause the balloon 80 to be in fluid communication with the actuation device 26. A one way check valve (not shown) may be located at the outlet port 68. The opening of the balloon 80 may be attached to the one way check valve or otherwise positioned so that the inflation gas 30 flows through the one way check valve and into the interior of the balloon 80.

Actuation of the actuation device 26 causes the inflation gas 30 to flow out of the outlet port 68 and into the balloon 80 to expand and then burst the balloon 80. The balloon 80 may expand through the aperture 74, and any film or other covering on the aperture 74 may be broken or blown off once the balloon 80 expands and pushes therethrough. This film or other covering may be blown off before the balloon 80 fully expands and bursts. The irritant 12 may be located within the balloon 80 when the balloon 80 is deflated and will be released upon bursting of the balloon 80 towards the attacker 78.

Figure 12:
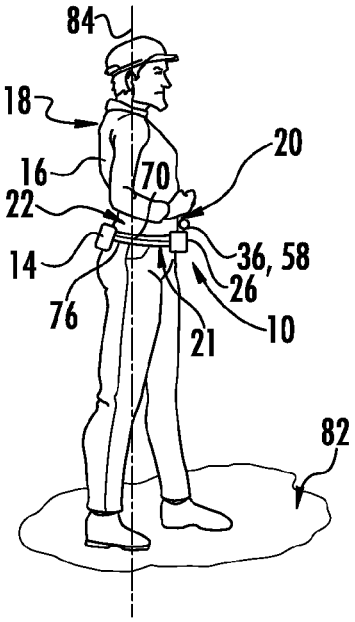
FIG. 12 is a side view of a user wearing a personal defense device in accordance with another exemplary embodiment.

FIG. 12 shows the user 16 standing on ground 82 and wearing the personal defense device 10. The personal defense device 10 can be arranged so that part of it is located at the front 20 of the user and so that other parts can be located at the back 18 of the user 16. In this regard, a coronal plane 84, sometimes referred to as a frontal plane 84, can divide the user 16 up into a back 18 and a front 20. The personal defense device 10 can be arranged so that a belt 76 is used to attach the irritant dispensing member 14 and the actuation device 26 to the waist 21 of the user 16. The actuation device 26 may be located at the front 20 of the user 16. The user 16 may actuate the actuation device 26 by pulling the pin 58 to cause inflation gas 30 to flow from the actuation device 26.

An inflation line 70 may be in fluid communication with the actuation device 26 and can be arranged so that the inflation gas 30 will flow around a portion of the waist 21 and cross the coronal plane 84 to the back 18 of the user 16. The inflation line 70 is in fluid communication with the irritant dispensing member 14 and may cause a balloon 80 of the irritant dispensing member 14 to inflate and burst to cause the irritant 12 to be dispensed as previously discussed. The inflation line 70 may be a flexible tube or hose that is capable of bending to accommodate the shape of the user's 16 body and other spacing concerns. The inflation line 70 may be made of a material strong enough to prevent crimping or leakage so that the inflation gas 30 is properly transferred. The irritant dispensing member 14 is located on the back 18 of the user 16 such that it is on an opposite side of the coronal plane 84 from that of the actuation device 26. This type of arrangement may allow the user 16 to actuate the personal defense device 10 from his or her front 20 while the irritant 12 is dispensed from his or her back 18 so that the user 16 does not have to turn around or even view the attacker 78 in a rearward direction. This flexibility allows for dispensing in situations in which it may not otherwise be possible to turn around to face the attacker 78.

Figure 13:
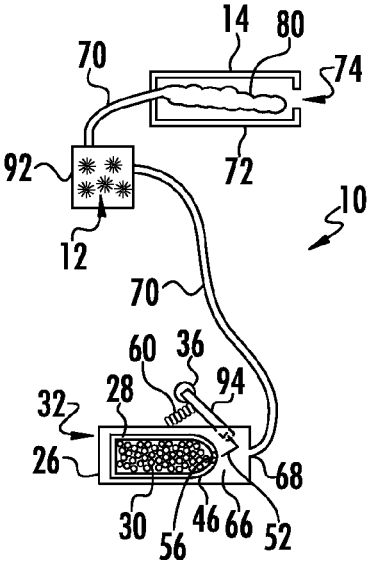
FIG. 13 is a partial cross-sectional front view of a personal defense device in which an irritant chamber is present in accordance with another exemplary embodiment.

Another exemplary embodiment of the personal defense device 10 is disclosed in FIG. 13. Here, the irritant dispensing member 14 and the actuation device 26 are separated from one another such that they are not located proximate to one another. The personal defense device 10 can be arranged so that some of the components are on one side of the coronal plane 84 and so that the remaining components are on the other side of the coronal plane 84. Further, certain components may have portions that are located on both sides of the coronal plane 84. The actuation device 26 has a pressurized cartridge 28 of inflation gas 30 as previously discussed housed within a body 64. The trigger member 36 has a handle 94 that is in pivoting engagement with the body 64 and is urged to an unactuated state by the spring 60. The spring 60 functions to pull the handle 94 back towards the body 64 so that the spring 60 resists actuation of the actuation device 26. This use of the spring 60 is essentially opposite to the use of the spring 60 in previously described arrangements that were used to urge the piercing member 52 towards the pressurized cartridge 28. When actuation is desired, the user 16 will grasp or otherwise urge the handle 94 in a direction opposite to the bias of the spring 60. In FIG. 13, the user 16 will urge the handle 94 in the clockwise direction. A piercing member 52 is attached to the handle 94 and moves towards and punctures the breakable seal 56 when the handle 94 is urged by the user.

The inflation gas 30 flows from the pressurized cartridge 28 out of the outlet port 68 and through the inflation line 70. An irritant chamber 92 is included in the personal defense device 10 of FIG. 13 that functions to house the irritant 12. The entrance and exit of the irritant chamber 92 may be blocked through the use of one way check valves, film, or other means. Pressurized inflation gas 30 from the inflation line 70 may flow into the irritant chamber 92 and force the irritant 12 from the irritant chamber 92 and out of the other portion of the inflation line 70 located above the irritant chamber 92 shown in FIG. 13. The combined inflation gas 30 and irritant 12 may then flow into the irritant dispensing member 14 and inflate balloon 80. The balloon 80 may expand through the aperture 74 and burst thus resulting in a release of the irritant 12 towards the attacker 78. The irritant chamber 92 and irritant dispensing member 14 may be located on one side of the coronal plane 84, and the actuation device 26 may be located on the opposite side of the coronal plane 84. Alternatively, the irritant chamber 92 may be located on the same side of the coronal plane 84 as the actuation device 26 and the irritant dispensing member 14 may be on the opposite side. Still further, the irritant dispending member 14, the actuation device 26, and the irritant chamber 92 may all be located on the same side of the coronal plane 84, either on the front 20 or the back 18 in accordance with various exemplary embodiments.

Figure 14:
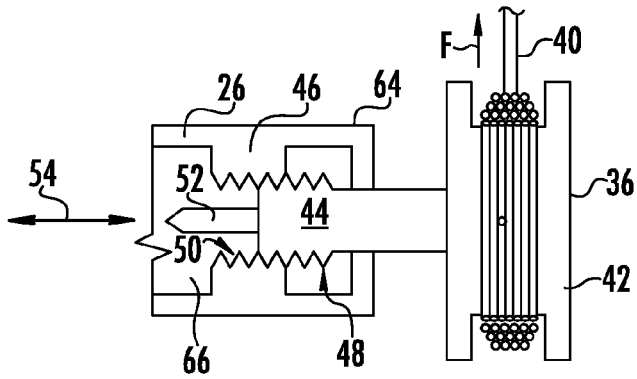
FIG. 14 is a partial cross-sectional front view of a trigger member in accordance with one exemplary embodiment.

The trigger member 36 used to actuate the actuation device 26 can be variously configured. The trigger member 36 may be designed so that it is easily actuated by the user 16 to cause the personal defense device 10 to release irritant 12. The trigger member 36 may be designed so that it does not inadvertently actuate by mistake to cause release of the irritant 12. In this regard, the sensitivity of the trigger member 36 may be made so that it functions only when the user 16 desires. The trigger member 36 can be provided in a variety of manners. A simple pin 58 may comprise the entire trigger member 36 in some embodiments, or the handle 94 may make up the trigger member 36 in other embodiments. FIG. 14 shows one embodiment of the trigger member 36 that includes a wheel 42. The wheel 42 may be rigidly attached to an end of the threaded plunger 44 so that rotation of the wheel 42 causes rotation of the threaded plunger 44. The threaded plunger 44 can be in threaded engagement with the body 64 so that the threaded plunger 44 moves in the linear direction 54 to effect breaking of the breakable seal 56 as discussed in previous embodiments.

The trigger member 36 may include a pull cord 40 that is attached to the wheel 42. Force F in the direction shown will exert tension on the pull cord 40. The pull cord 40 may be wrapped multiple times around the wheel 42. This tension force F may cause the pull cord 40 to be unwound from the wheel 42. The force from the unwinding may cause a frictional force to be developed on the remaining pull cord 40 on the wheel 42 or directly on the wheel 42 itself. This frictional force may cause the wheel 42 to in turn rotate thus resulting in rotation of the threaded plunger 44 and linear movement of same. The very end of the pull cord 40 may be attached to the wheel 42 to prevent removal of same and also to effect turning of the wheel 42 when force F is applied to the pull cord 40. The arrangement of the wheel 42 and pull cord 40 used to turn the threaded plunger 44 is only exemplary, and various other arrangement of causing force F on the pull cord 40 to turn wheel 42 to cause the threaded plunger 44 to turn are possible in other exemplary embodiments.

Figure 15:
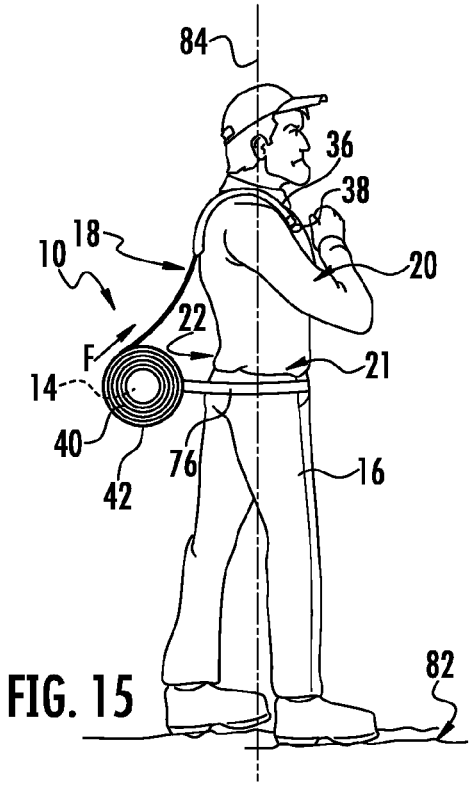
FIG. 15 is a side view of a user wearing a personal defense device that incorporates the trigger member of FIG. 14.

FIG. 15 illustrates the personal defense device 10 of FIG. 14 as worn by the user 15. The wheel 42 and actuation device 26 are located on the back 18 of the user 16, and a handle 38 of the trigger device 36 is located at the front 20 of the user 16. The wheel 42 and actuation device 26 may be located at the small of the back 22 and attached through the use of the belt 76. The pull cord 40 may extend from the wheel 42 past the coronal plane 84 and onto the front of the shoulder or to the chest of the user 16. A handle 38 can be attached to one end of the pull cord 40 so that the user can grasp the handle 38 and apply a downward force. Additionally or alternatively, the force applied by the user 16 upon grasping and pulling the handle 38 may be in the direction away from the user's 16 body so as to be in front of the user. This force will be translated back to the wheel 42 to cause the wheel 42 to rotate and the irritant 12 to be dispensed. Instead of being located at the chest or the front of the shoulder of the user, the handle 38 may be placed at any other location on the user 16 whether on the front 20 or back 18.

The pull cord 40 can be situated so that sufficient slack is afforded the user 16 in the unactuated state 32 to allow the user 16 a wide range of movement. The pull cord 40 can go around and over the back and shoulders of the user 16 and can be of a size and texture sufficient to prevent snagging or friction burns when pulled against the user 16. Guides or other mechanisms may be present to help house the pull cord 40 to facilitate its positioning around the various portions of the user 16 and the clothing or items carried by the user 16. The pull cord 40 may be made of nylon or any other type of material such as yarn or metal.

Figure 16:
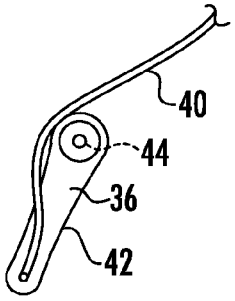
FIG. 16 is a side view of a trigger member in accordance with another exemplary embodiment in an unactuated state.
Figure 17:
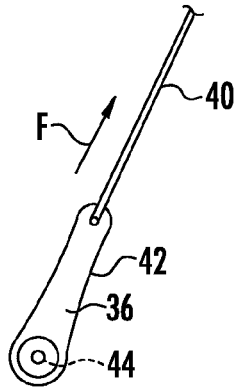
FIG. 17 is a side view of the trigger member of FIG. 16 in an actuated state.

FIGS. 16 and 17 illustrate another exemplary embodiment of the trigger member 36. Instead of a wheel, the trigger member 36 may include an arm 42 that is rigidly connected to the threaded plunger 44. The arm 42 is shown in the unactuated state in FIG. 16. The pull cord 40 is attached on one end to the arm 42 and to a handle 38 or other device on the opposite end. The arm 42 is capable of pivoting with the threaded plunger 44 in the manner previously discussed to cause the threaded plunger 44 to move linearly and a repeat of this information is not needed. The user 16 may apply force to the pull cord 40 to cause the pull cord 40 to move into a tensioned state as shown with reference to FIG. 17 in which the arm 42 is in an actuated state. The force F exerted by the pull cord 40 causes the arm 42 to rotate upwards approximately 180° from the unactuated state shown in FIG. 16. As such, the arm 42 may rotate less than one full rotation in order to cause the actuation device 26 to actuate. The distance between the piercing member 52 and the breakable seal 56 can be modified, and the threading 48 and 50 can be modified, or other features may be modified so that a rotation of less than 360° causes the breakable seal 56 to be broken to cause release of the inflation gas 30 from the actuation device 26.

Figure 18:
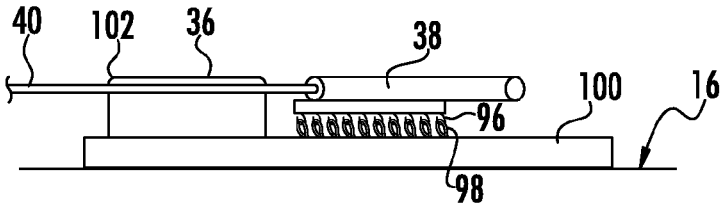
FIG. 18 is a partial cross-sectional side view of a trigger member in accordance with another exemplary embodiment.

Another exemplary embodiment of the trigger member 36 is shown in FIG. 18. Here, the trigger member 36 includes a patch 100 that can be sewn, adhered, or otherwise attached to a jacket 104 of the user. It is to be understood that the patch 100 could be attached to a shirt, pants, or other item of clothing of the user 16 in other arrangements and that attachment to a jacket 104 is only exemplary. The patch 100 may include loops 98 of hook and loop type material, and the patch 100 may include a guide 102 that is simply a closed loop that is open therethrough. A handle 38 of the trigger member 36 can have hooks 96 of the hook and loop type faster attached thereto. The hooks 96 engage the loops 98 in FIG. 18 so that the handle 38 is attached to the patch 100 and prevented from falling or moving off of the user 16. The pull cord 40 extends from the handle 38 through the guide 102.

Figure 19:
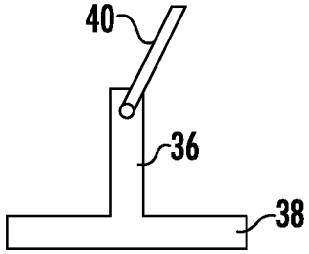
FIG. 19 is a front view of a trigger member in accordance with a different exemplary embodiment.
Figure 20:
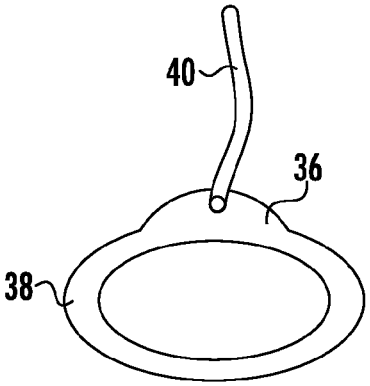
FIG. 20 is a front view of a trigger member in accordance with a still further different exemplary embodiment.

In use, the user 16 may grasp the handle 38 and apply force to the handle 38 sufficient to disengage the hooks 96 and loops 98. The user can then apply force to the handle 38 to cause the actuation device 26 to actuate. The guide 102 acts as a guide to help guide the user 16 in pulling on the handle 38 in the proper direction so that the pull cord 40 will supply force to the actuation device 26 as intended. The shape of the handle 38 can be variously configured. With reference now to FIGS. 19 and 20, the handle 38 can be "T" in shape or may have a loop into which one or more fingers of the user 16 can be placed for grasping. It is to be understood that the arrangements of the pull cord 40 portion of the trigger member 36 are only exemplary and that others are possible in accordance with other exemplary embodiments.

Figure 21:
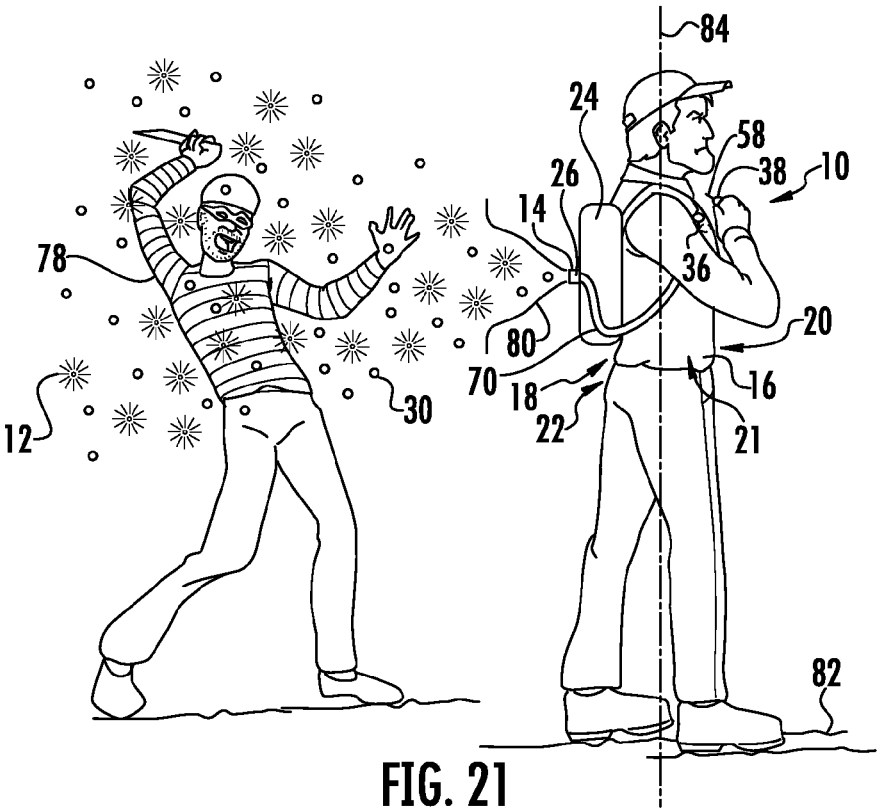
FIG. 21 is a side view of a person wearing a personal defense device on a backpack and dispensing irritant into the face of an attacker.

FIG. 21 shows the personal defense device 10 carried by the user 16 such that the irritant dispensing member 14 is located on a backpack 24 that is strapped to the shoulders and carried on the back 18 of the user 16. The irritant dispensing member 14 could be located in a pocket of the backpack 24 or sewn or otherwise adhered to an exterior surface of the backpack 24. An inflation line 70 extends to the actuation device 26 that, along with the trigger member 36 are located on the front 20 of the user 16. A pin 58 can be pulled by the user 16 to actuate the personal defense device 10. The dispensed irritant 12 is shown being blasted into the face of an attacker 78.

Figure 22:
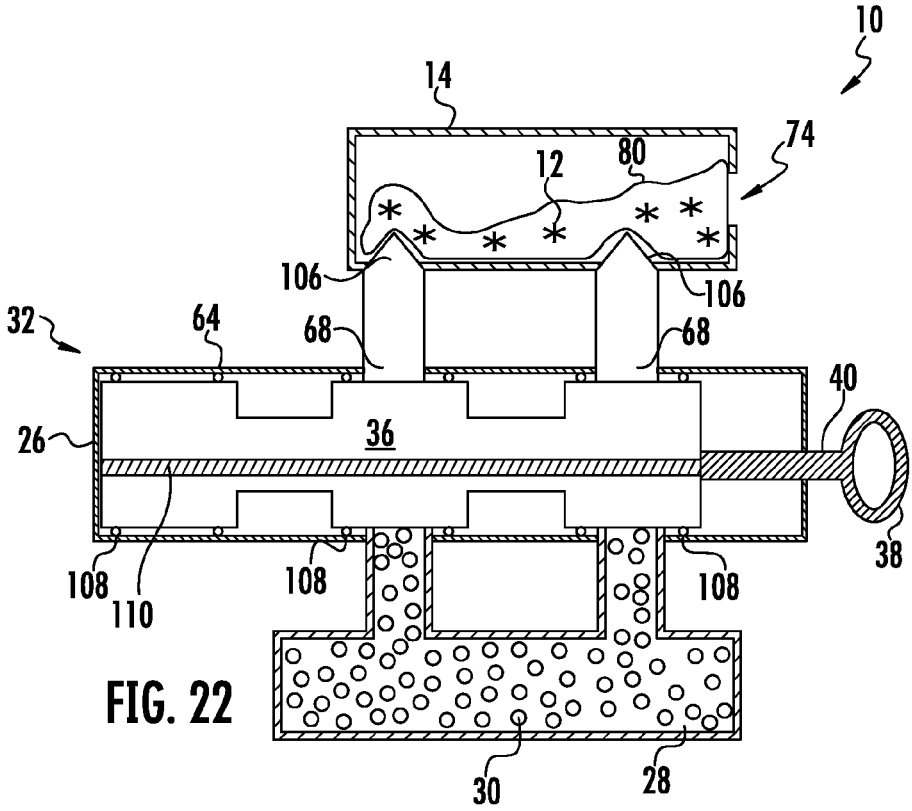
FIG. 22 is a cross-sectional side view of a personal defense device in an unactuated state in another exemplary embodiment.
Figure 23:
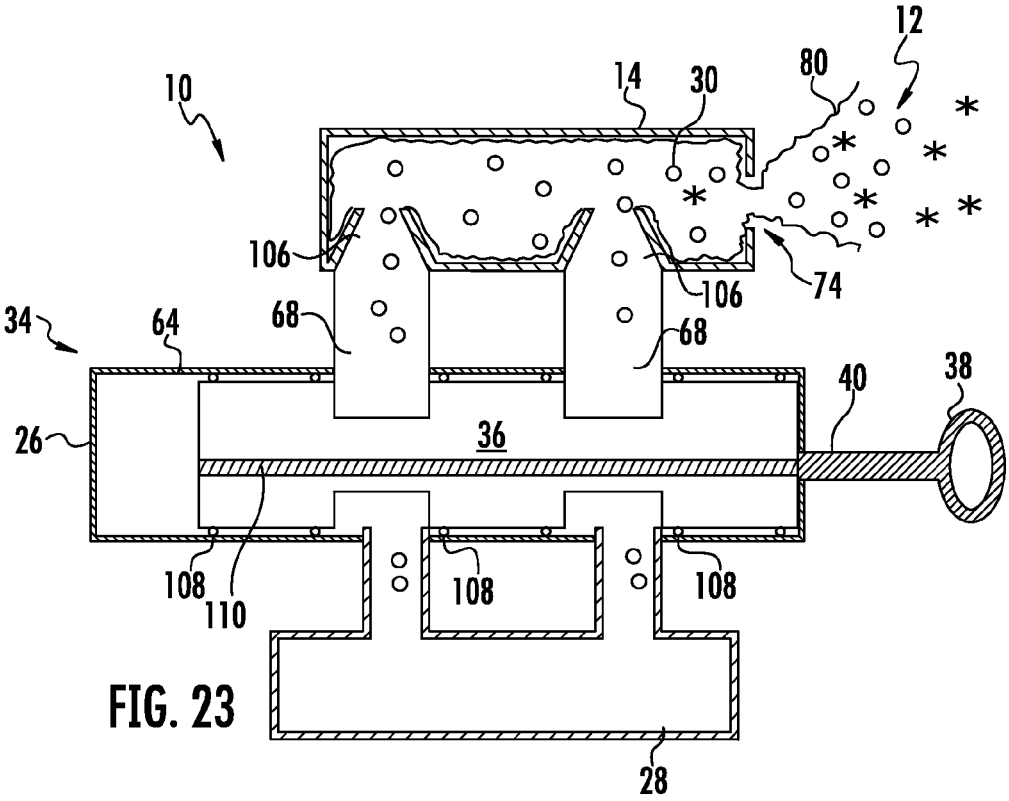
FIG. 23 is a cross-sectional side view of the personal defense device of FIG. 22 in an actuated state.

A further exemplary embodiment of the personal defense device 10 is disclosed with reference to FIGS. 22 and 23. The actuation device takes the form of a cylindrical member having a pair of lower inlet ports and a pair of upper outlet ports 68. A pressurized cartridge 28 includes inflation gas 30 under pressure in the unactuated state 32 of the actuation device 26 in FIG. 22. The inflation gas 30 cannot move through the internal cavity of the actuation device 26 because the lower ports of the actuation device 26 are blocked by the trigger member 36. The trigger member 36 may be supplied with one or more o-rings 108 in order to further seal the connection or point of contact between the trigger member 36 and the body 64 of the actuation device 26. The o-rings 108 engage the trigger member 36 and the interior wall of the body 64.

A user 16 may grasp the handle 38 and pull the pull cord 40 in order to move the trigger member 36 with respect to the actuation device 26. The pull cord 40 may be a rigid member, or may be a flexible member in accordance with various exemplary embodiments. This movement is to the right in FIG. 23 that shows the actuation device 26 in the actuated state 34. The o-rings 108 can slide along the interior wall of the body 64 and thus do not prevent relative movement. The trigger member 36 includes two sections that have a smaller diameter than adjacent sections. Movement of the trigger member 36 causes these two smaller diameter sections to become aligned with the inlet ports from the pressurized cartridge 28. This alignment causes inflation gas 30 to flow from the pressurized cartridge 28 and into the actuation device 26 via the ports at the bottom of the actuation device 26 and then past the smaller diameter sections of the trigger member 36. The inflation gas 30 may then exit via the outlet ports 68 and flow past one way valves 106. The one way valves 106 allow gas to enter the balloon 80 located in the irritant dispensing member 14 but not exit from the irritant dispensing member back to the outlet ports 68. The one way valves 106 need not be present in other exemplary embodiments. The inflation gas 30 may inflate the balloon 80 and cause it to burst to release the irritant 12.

The trigger member 36 may be provided with an air passageway 110 that can extend through the axial length of the trigger member 36. The air passageway 110 may be provided to ensure that a suction force is not developed within the actuation device 26 that may prevent the user 16 from moving the trigger member 36 relative to the actuation device 26. Movement of the trigger member 36 to the right may allow air that is to the right side of the trigger member 36 to flow back through the air passageway 110 to the left side of the trigger member 36. Moving the trigger member 36 to the left causes a reversal of this air flow. The air passageway 110 may extend through an axial center of the trigger member 36, or may be offset from the axial center. The personal defense device 10 can thus be reusable in certain embodiments.

Although described as being located at the small of the back 22 or back 18 of the user 16, it is to be understood that the irritant dispensing member 14 may be carried at any location on the user 16 and that the disclosed locations are only exemplary. For instance, the irritant dispensing member 14, or entire personal defense device 10, may be located at the front 20 of the user 16 such as on the user's chest, knee, or stomach. Further, although shown as being dispensed through a balloon 80, the irritant 12 can be dispensed in other manners in accordance with other exemplary embodiments such as via a spray stream. The dispensing of the irritant 12 through use of the balloon 80 is only one exemplary embodiment and others are possible.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A personal defense device, comprising:

irritant;

an irritant dispensing member that is carried on the back of a user, wherein the irritant dispensing member is configured for dispensing the irritant such that the irritant is dispensed behind the user; and an actuation device that has a pressurized cartridge that contains an inflation gas when the actuation device is in an unactuated state;

wherein the irritant dispensing member is a balloon, and wherein when the actuation device is actuated the inflation gas is transferred into the balloon to inflate the balloon and to cause the balloon to burst, and wherein the irritant is located within the balloon as the balloon is inflating and is dispensed once the balloon bursts.

2. The personal defense device as set forth in claim 1, wherein the irritant dispensing member is carried by the user such that the irritant dispensing member is located at the small of the back of the user.

3. The personal defense device as set forth in claim 1, wherein the user has a backpack that is worn on the back of the user, and wherein the irritant dispensing member is located on the backpack such that the irritant dispensing member is carried on the back of the user.

4. The personal defense device as set forth in claim 1, further comprising a trigger member that is actuated by the user to cause actuation of the actuation device, wherein the trigger member has a handle that is configured for being grasped and pulled by the user when actuation is desired, wherein the trigger member has a pull cord attached to the handle on one end, wherein the trigger member has a wheel attached to the pull cord on an opposite end from the handle such that grasping of the handle and pulling of the handle by the user causes the pull cord to exert force on the wheel to cause the wheel to rotate.

5. The personal defense device as set forth in claim 4, wherein the actuation device has a threaded plunger in communication with the wheel such that as the wheel rotates the threaded plunger rotates, wherein the threaded plunger is in threaded engagement with a wall of the actuation device, wherein the actuation device has a piercing member that is rigidly attached to the threaded plunger such that as the threaded plunger moves in a linear direction the piercing member also moves in a linear direction, wherein the pressurized cartridge has a breakable seal that is punctured upon being engaged by the piercing member through linear movement of the piercing member, wherein puncturing of the breakable seal causes the inflation gas to be released from the pressurized cartridge.

6. The personal defense device as set forth in claim 1, further comprising a trigger member that is actuated by the user to cause actuation of the actuation device, wherein the trigger member has a handle that is configured for being grasped and pulled by the user when actuation is desired, wherein the trigger member has a pull cord attached to the handle on one end, wherein the trigger member has a pin attached to the pull cord on an opposite end from the handle, wherein the actuation device has a spring and a piercing member, wherein the pin engages the actuation device in the unactuated state to prevent the piercing member from puncturing a breakable seal of the pressurized cartridge, and wherein actuation of the trigger member by the user by grasping of the handle and pulling of the handle causes the pull cord to exert force on the pin to cause the pin to move to allow the spring to urge the piercing member towards the pressurized cartridge to puncture the breakable seal to cause the inflation gas to be released from the pressurized cartridge.

7. The personal defense device as set forth in claim 1, wherein the actuation device has a body with an interior passageway into which the inflation gas flows once the actuation device is actuated, wherein the actuation device has an outlet port through which the inflation gas flows from the interior passageway, and further comprising an inflation line in fluid communication with the outlet port and with the balloon to allow the inflation gas to flow from the outlet port through the inflation line and into the balloon to inflate the balloon and to cause the balloon to burst, wherein the pressurized cartridge is a $CO_2$ cartridge.

8. The personal defense device as set forth in claim 1, wherein the irritant is bear spray.

9. The personal defense device as set forth in claim 1, further comprising:

a housing that carries the irritant dispensing member, wherein the housing defines an aperture through which the irritant dispensing member moves when the irritant dispensing member is actuated from an unactuated state to an actuated state, wherein the irritant is located within the irritant dispensing member when the irritant dispensing member is in the unactuated state; and a belt that is attached to the housing, wherein the user is capable of placing the belt around the waist of the user to cause the housing and the irritant dispensing member to be located at the back of the user.

10. A personal defense device, comprising:

an irritant;

an irritant dispensing member that is a balloon that is configured for being inflated to such an extent that the balloon bursts to cause the irritant located inside of the balloon to be dispensed; and an actuation device that has an inflation gas that is used to inflate and burst the balloon.

11. The personal defense device as set forth in claim 10, wherein the irritant dispensing member is carried by a user such that the irritant dispensing member dispenses the irritant behind the user.

12. The personal defense device as set forth in claim 11, wherein the irritant dispensing member is worn on the back of the user.

13. The personal defense device as set forth in claim 10, further comprising a trigger member that is actuated by the user to cause actuation of the actuation device, wherein the trigger member has a handle that is configured for being grasped and pulled by the user when actuation is desired, wherein the trigger member has a pull cord attached to the handle on one end, wherein the trigger member has a wheel attached to the pull cord on an opposite end from the handle such that grasping of the handle and pulling of the handle by the user causes the pull cord to exert force on the wheel to cause the wheel to rotate;

wherein the actuation device has a threaded plunger in communication with the wheel such that as the wheel rotates the threaded plunger rotates, wherein the actuation device has a piercing member that is rigidly attached to the threaded plunger such that as the threaded plunger moves in a linear direction the piercing member also moves in a linear direction, wherein the actuation device has a pressurized cartridge into which the inflation gas is stored before it is used to inflate and burst the balloon, wherein the pressurized cartridge has a breakable seal that is punctured upon being engaged by the piercing member through linear movement of the piercing member, wherein puncturing of the breakable seal causes the inflation gas to be released from the pressurized cartridge and to flow into the balloon to inflate and burst the balloon.

14. The personal defense device as set forth in claim 10, further comprising a trigger member that is actuated by the user to cause actuation of the actuation device, wherein the trigger member has a handle that is configured for being grasped and pulled by the user when actuation is desired, wherein the trigger member has a pull cord attached to the handle on one end, wherein the trigger member has a pin attached to the pull cord on an opposite end from the handle;

wherein the actuation device has a spring, a piercing member, and a pressurized cartridge into which the inflation gas is stored before it is used to inflate and burst the balloon, wherein the pin engages the actuation device in the unactuated state to prevent the piercing member from puncturing a breakable seal of the pressurized cartridge, and wherein actuation of the trigger member by the user by grasping of the handle and pulling of the handle causes the pull cord to exert force on the pin to cause the pin to move to allow the spring to urge the piercing member towards the pressurized cartridge to puncture the breakable seal to cause the inflation gas to be released from the pressurized cartridge and to flow into the balloon to inflate and burst the balloon.

15. The personal defense device as set forth in claim 10, wherein the irritant is bear spray.

16. The personal defense device as set forth in claim 10, wherein the irritant is pepper spray, and wherein the irritant is located inside of the balloon when the balloon is deflated before actuation.

17. The personal defense device as set forth in claim 10, wherein the actuation device has a body with an interior passageway into which the inflation gas flows once the actuation device is actuated, wherein the actuation device has an outlet port through which the inflation gas flows from the interior passageway, and further comprising:

an inflation line in fluid communication with the outlet port and with the balloon to allow the inflation gas to flow from the outlet port through the inflation line and into the balloon to inflate the balloon and to cause the balloon to burst;

a housing that carries the irritant dispensing member, wherein the housing defines an aperture through which the balloon moves when the balloon is actuated from an unactuated state to an actuated state, wherein the irritant is located within the balloon when the balloon is in the unactuated state; and a belt that is attached to the housing, wherein the user is capable of placing the belt around the waist of the user to cause the housing and the balloon to be located at the back of the user.

18. A personal defense device, comprising:

irritant;

an irritant dispensing member that is a balloon that is carried on the back of the user, wherein the balloon is configured for being inflated to such an extent that the balloon bursts, wherein the irritant is located inside of the balloon at the time of bursting such that bursting causes the irritant to be dispensed, wherein the balloon is located in relation to the user at the time of bursting such that the irritant is dispensed behind the user;

an actuation device that has a pressurized cartridge with an inflation gas that is used to inflate and burst the balloon to cause the irritant to be dispensed; and a trigger member that is capable of being actuated by the user, wherein actuation of the trigger member causes the pressurized cartridge to release the inflation gas to cause the inflation gas to inflate and burst the balloon to cause the irritant to be dispensed.

* * * * *